US007048589B2

(12) United States Patent
Bricaud et al.

(10) Patent No.: US 7,048,589 B2
(45) Date of Patent: May 23, 2006

(54) SHORT SMART CARD CONNECTOR

(75) Inventors: Herve Guy Bricaud, Dole (FR); Yves Pizard, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/076,120

(22) Filed: Mar. 9, 2005

(65) Prior Publication Data

US 2005/0170677 A1 Aug. 4, 2005

Related U.S. Application Data

(63) Continuation-in-part of application No. PCT/EP03/50384, filed on Aug. 20, 2003.

(30) Foreign Application Priority Data

Sep. 12, 2002 (FR) ..... 02 11300

(51) Int. Cl.
*H01R 24/00* (2006.01)

(52) U.S. Cl. ..... 439/630; 439/326

(58) Field of Classification Search ..... 439/630, 439/326, 325; 235/441
See application file for complete search history.

(56) References Cited

U.S. PATENT DOCUMENTS 5,823,828 A * 10/1998 Bricaud et al. ..... 439/630
6,352,445 B1 * 3/2002 Takei et al. ..... 439/489
6,386,920 B1 5/2002 Sun
6,699,061 B1 * 3/2004 Abe et al. ..... 439/377
6,830,474 B1 * 12/2004 Liu et al. ..... 439/489
2001/0010983 A1 * 8/2001 Bricaud et al. ..... 439/630
2002/0009914 A1 * 1/2002 Yahiro et al. ..... 439/326

FOREIGN PATENT DOCUMENTS

EP 0 803 834 A2 10/1997
WO WO 01/29934 A1 4/2001
WO WO 2004/025788 A1 3/2004

* cited by examiner

*Primary Examiner*—Alexander Gilman
(74) *Attorney, Agent, or Firm*—Peter Van Winkle

(57) ABSTRACT

A connector with a cover element (80) lying in a forward position over an insulative support (40), allows a smart card to be inserted despite obstructions lying closely behind the connector. The card is initially inserted at a downward-forward incline and then its rear is pushed down so the card is horizontal. Then the cover element is slid to a rearward position to prevent card tilt. Contact blades (70) have upwardly biased contact ends (72) that lie substantially in a single transverse plane (Pv) and engage a single row of card contact pads at the front of the card. This allows the cover element rear position to lie only a short distance rearward of its front position so the support supports less than half the card length, thereby allowing a short support to be used. The cover element has a rear portion (85) bent at a rearward-upward incline and forming a convex lower rear face part (A).

2 Claims, 13 Drawing Sheets

SHORT SMART CARD CONNECTOR

CROSS REFERENCE

This is a continuation-in-part of PCT application PCT/EP2003/050384 filed 20 Aug., 2003 and designating the U.S., which claims priority from French patent application 0211300 filed 12 Sep., 2002.

BACKGROUND OF THE INVENTION

The present invention relates to an electrical connector for an electronic memory smart card with large storage capacity, such as an SD (Secure Digital) card marketed by SANDISK. All the features and performance characteristics of the SD card are defined in the documents issued by the SDCA (SD Card Association), the address of which is 53 Muckelemi St., P.O. Box 189, San Juan Bautista, Calif. 95045-0189 USA.

This SD card belongs to the family of memory cards already containing MMC (Multimedia Card) cards, these two types of card being marketed by SANDISK. The overall dimensions of MMC and SD cards are identical with the notable exception of the thickness of the SD card which is greater, this increase corresponding to the increase in memory capacity of such a card. The invention also relates to a connector for connecting another card with large storage capacity known as an MSD (Memory Stick Duo) card marketed by SONY. All of the features and performance characteristics of the MSD card are defined in the document published by the SONY Corporation and entitled "Memory Stick Standard—Memory Stick Duo Format Specification ver. 1.0—August 2001".

In general, a card is placed in a position of full insertion, in which the card is electrically connected, and the card extracted by the user after use using ejection means built into a connector. The connector should be compact, economical, and contain a low number of parts. The total length of the "card+connector" assembly needs to be reduced as far as possible, because it may dictate the size of small equipment such as a cell phone.

According to a first known design used for example in performing banking transactions, the apparatus uses motorized means to eject the card to a position such that the card can be gripped by the user. In another design, the fully inserted card protrudes by more than a centimeter from the connector to allow the user to grasp the card rear portion and pull it horizontally out of the connector. However, when the card is small in size, particularly in the longitudinal direction, it is difficult to have the card projects from the receiving device by just a few millimeters from the connector so the card can be grasped.

Applicant previously has proposed a design of electrical connector able with equal ease to take either SD cards or MMC cards, which is particularly compact but also does not incorporate means for ejecting the card from the connector. When the connector, on the printed circuit board that bears it, is surrounded by components or by other elements belonging to the electronic equipment equipped with the connector, it is impossible for the card to be inserted or extracted in the horizontal longitudinal direction, manually or automatically using ejection means built into the connector.

There has previously been described in WO-A-98/13784 (The Whitaker Corporation) a connector for a SIM (Subscriber Identification Module) or MICROSIM type card of rectangular overall shape and comprising, in a central region of its lower main face, conducting pads which engage contact ends of elastically deformable conducting blades on the horizontal bottom of a card housing. Such connector has an element for manually locking the card, which element slides between a forward position allowing the card to be put in place and a rear position in which it holds the card in the horizontal contact position in which an upper part of the moving locking element extends over the upper face of the card.

Such a design allows the card to be inserted generally in a vertical direction by bringing the card "over" the connector. However, handling is complicated and the proposed design is specific to a MICROSIM card. In addition, this design entails a translational movement in the lengthwise direction of the card, and a thickness of wall of insulating material behind the transverse rear edge of the card. These two requirements entail a corresponding increase in the lengthwise size of the "card+connector" assembly. In order to achieve partial ejection of the card by tilting thereof, this design additionally envisages a molded plastic elastic blade extending over the card and increasing the total thickness or height of the connector.

It is desirable for the card to be able to be inserted and extracted within a small volume, corresponding to a volume bounded lengthwise by the front end edge of the insulating body of the connector and by the rear transverse edge of the card when the card is in a horizontal contact position in the connector. In this position a wall or components faces and substantially contacts the rear edge of the card. It is desirable that handling of the card can be performed without any longitudinal movement of the card in the horizontal plane.

SUMMARY OF THE INVENTION

In accordance with one embodiment of the present invention, a smart card connector is provided for engaging card contact pads lying near the front edge of the card. The connector includes an insulative support that holds contact blades and also includes a cover element, or locking element that is slideably mounted on the support. The cover element has a curved rear edge face for guiding the card as the card is inserted along an inclined plane parallel to the edge face. The rear edge face then allows the card to be tilted to a horizontal position by sliding and pivoting along the edge face. The cover element is then slid rearward to its rear position in which it retains the fully inserted card.

According to other features of the invention:

- the housing is bounded longitudinally towards the front by a front transverse edge which constitutes a stop against which the front transverse edge of the card bears as the front longitudinal end part of the card is introduced into the housing along the inclined plane;
- the connector comprises a series of elastically deformable blades which extend longitudinally and each of which has a contact convex curved first end which, in the absence of a card, occupies a position of rest in which it projects vertically upwards above the bottom of the housing, the contact curved ends of all the blades lying substantially at the same height in the rest position so that when the card is introduced in the inclined position, this card bears against the said contact curved ends;
- the contact curved ends of at least one group of contact blades are longitudinally aligned substantially in a transverse plane;

this transverse plane in which the contact curved ends lie lies longitudinally between the front and rear extreme positions of the edge face with respect to the insulating support;

the bottom of the housing formed in the insulating support comprises a recess which extends along the said front transverse abutment edge and which receives the front longitudinal end part of the card as it is introduced into the housing along the said inclined plane;

the upper face of the recess is an inclined flat surface portion;

the insulating support is longitudinally delimited by a rear transverse face beyond which the main portion of the body of the card extends, unsupported, rearwards;

the length of the front longitudinal end portion of the card received in the housing delimited by the said front transverse edge and by the said rear transverse edge of the insulating support is less than the transverse width of the card;

the length of the front longitudinal end portion of the card received in the housing is less than 25% of the total length of the card;

the connector comprises a switch for detecting the state of a write-protection device protecting the card, which comprises a moving detection blade oriented generally longitudinally and borne by the insulating support and which comprises a detection portion which extends transversely towards the inside of the housing in the direction of the longitudinal edge opposite belonging to the card, and in that the detection portion comprises an inclined upper face shaped as a ramp which is able to collaborate with a lower longitudinal edge face of the card;

the moving locking element is a metal part;

the moving locking element is produced in the form of an upper plate which extends over the upper face of the card and the parallel lateral edges of which are continued by two turned-down rims constituting slideways allowing it to be mounted with sliding on the insulating support.

Other features and advantages of the invention will become apparent from reading the detailed description which will follow, for an understanding of which reference will be made to the attached drawings.

DESCRIPTION OF THE PREFERRED EMBODIMENTS

In the description that will follow, components which are identical, similar to or analogous will be denoted by the same references. Without implying any limitation, the terms vertical, longitudinal and transverse will be used with reference to the directions V, L, T of the trihedral frame of reference L, V, T indicated in the figures.

Figure 1:
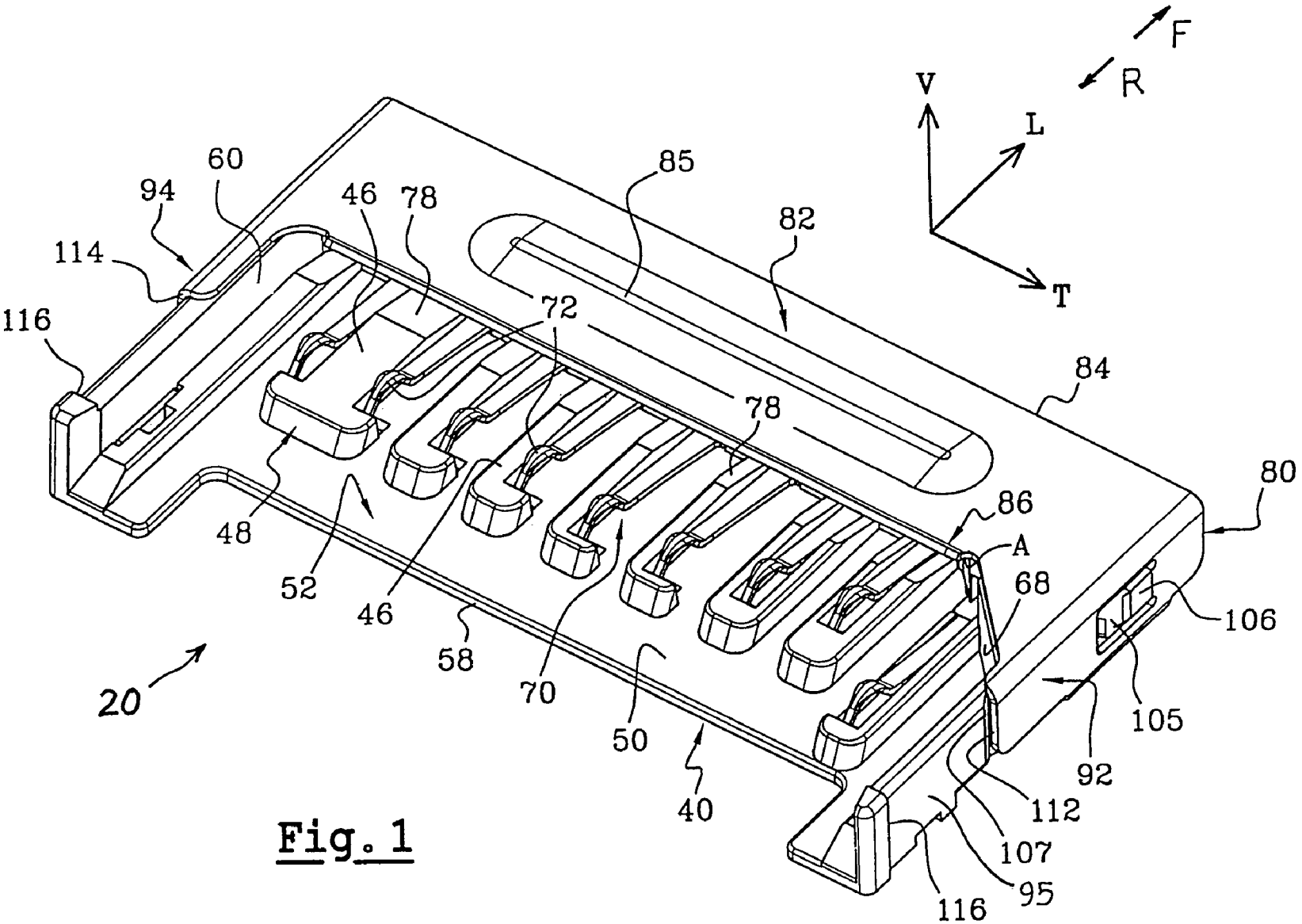
FIG. 1 is a top and rear isometric view of a connector of a first embodiment of the invention, in which the cover element lies in the forward position.

FIG. 1 shows an electrical connector 20 intended to receive a card C (FIG. 13) which here is a card of the SD type. The card C is of rectangular overall shape. In the upside-down position of FIG. 13 the card is seen having parallel left and right edges 24, 22 and front and rear edges 26, 28. The card C includes, in its right edge 22, a notch 25. In certain applications the notch 25 allows the SD card lo be immobilized longitudinally with respect to complementary means of the connector received in the notch 25. In its left edge 24, the card C has a write-protect device consisting of a cut-out 28. A slider 30 in the cut-out can occupy a rear position (FIG. 13) when the protection is not activated and a forward position when the protection is activated. The front right corner 32 of the card has a corner face cut off at 45°.

In its lower flat face 34, the card C comprises, near its front transverse edge 26, contact pads P of which here there are nine P1 to P9. All the free lower faces of the nine contact pads P1 to P9 are coplanar and are vertically offset upwards with respect to the plane of the lower face 34 of the card C. The general design of the connector 20 is known.

Figure 2:
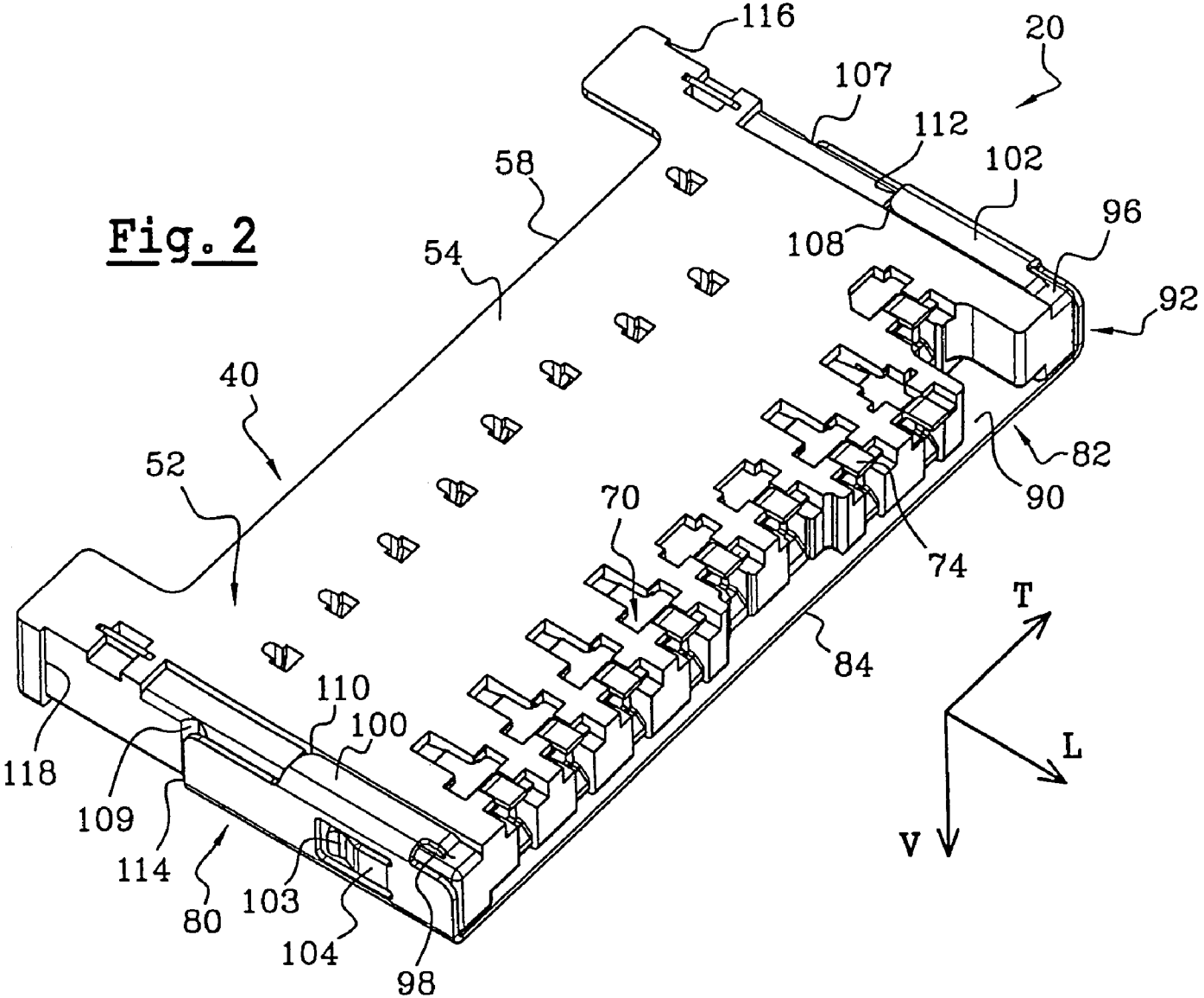
FIG. 2 is an upside-down isometric view from beneath of the connector of FIG. 1.
Figure 3:
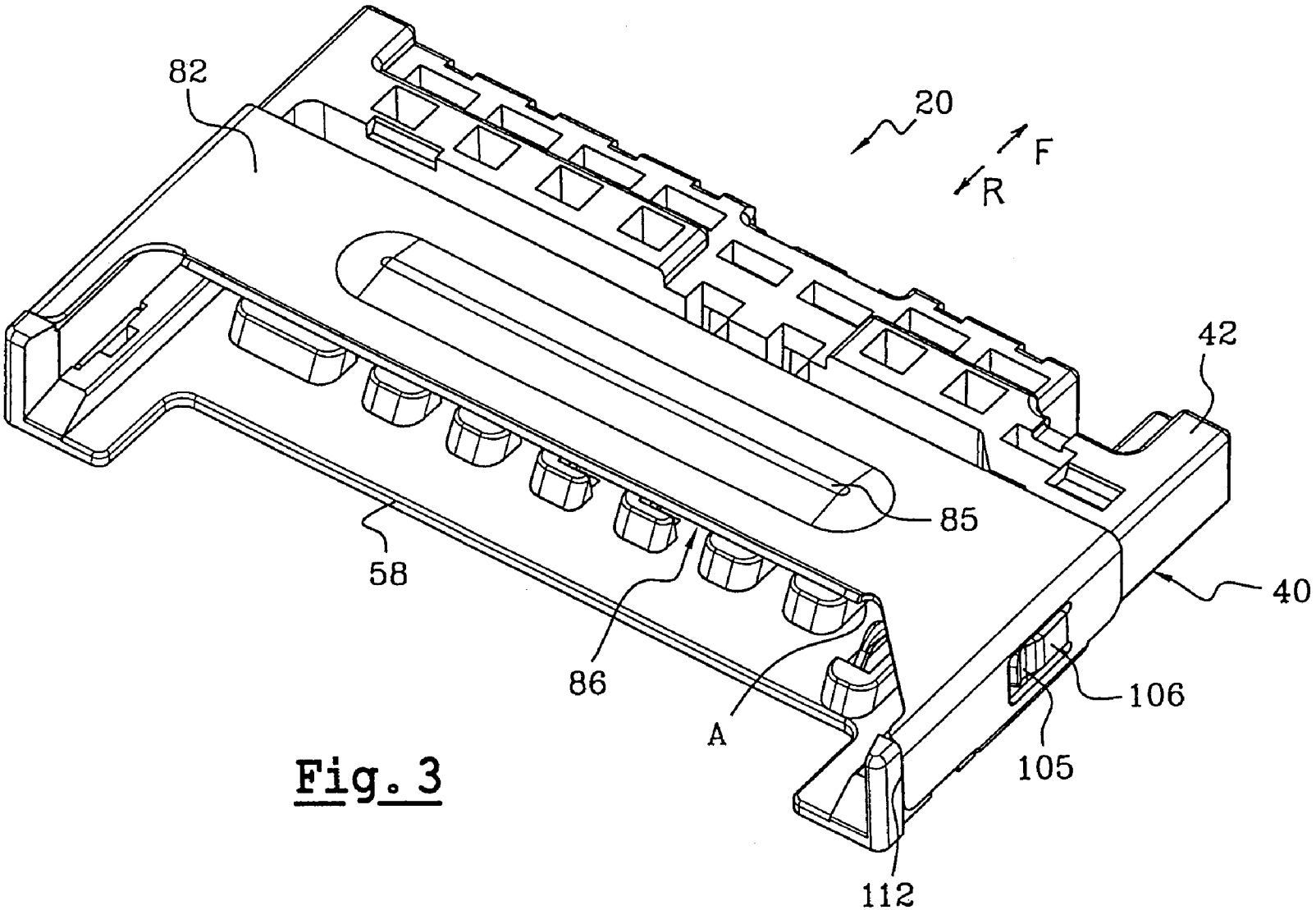
FIG. 3 is a view similar to that of FIG. 1, in which the cover element lies in the rear position for retaining a card.
Figure 8:
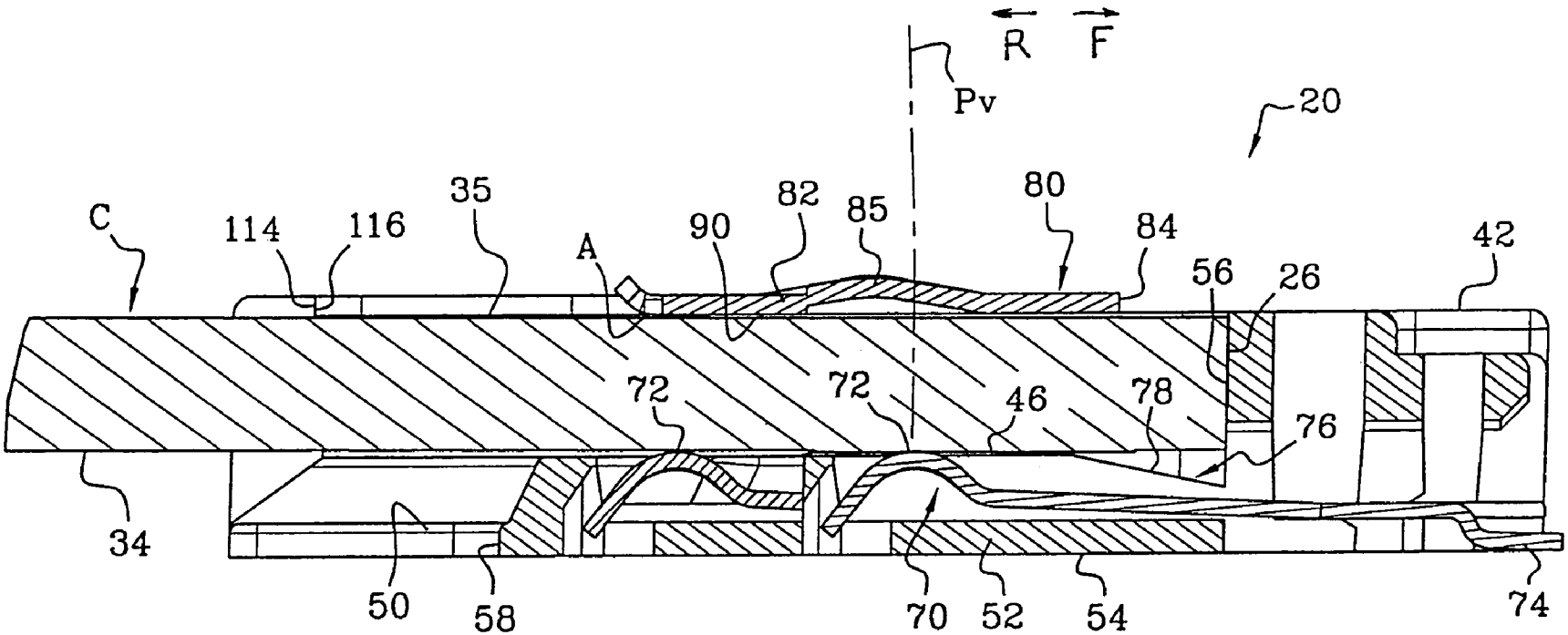
FIG. 8 is a view similar to that of FIGS. 6 and 7, in which the card is depicted in a horizontal contact position after it has been locked down by the cover element.

The connector includes an insulating support 40 (FIG. 5) of plastic in the overall shape of a plate having a flat and horizontal upper face 42 in which is formed a card-receiving cavity 44 intended to receive the front longitudinal end section of the card, and which is open vertically upwards. The cavity 44 has a horizontal lower cavity bottom 46. The cavity bottom 46 (FIG. 8) will lie adjacent to the lower face 34 of the card C in the horizontal contact position as illustrated in FIG. 8. As shown in FIG. 1 the cavity bottom has coplanar upper faces 46 of box-like elements 48 formed in relief over the upper face 50 of a planar bottom wall 52 of the insulating support. The bottom wall itself has a horizontal flat bottom face 54 (FIG. 2). The boxes 48 protect the contact blades of the connector 20.

The card-receiving cavity 44 (FIG. 5) has a transverse and vertical front end or wall 56, while the cavity 44 is open toward the rear R. The cavity has a rear edge 58 formed by the bottom plate 52.

To guide the card in the transverse T direction, the cavity is provided with two vertical and parallel longitudinal edges, including left edge or side 60 and right edge or side 62. The sides 60, 62 each extends longitudinally towards the rear, beyond the rear edge 58, by forming lateral extensions 64, 66 of the insulating support 40.

The front right corner 68 (FIG. 5) of the support lies at the intersection of the front transverse edge 56 and the right longitudinal edge 62. The corner 68 has a standardized corner face 68 cut off at 45° to polarize, or error proof the position and orientation of the card C in collaboration with the cut-off corner face of the card.

The connector 20 comprises a series of nine elastic contact blades 70. The contact blades 70 are identical and each has a contact free rear longitudinal end of convex curved shape 72 (FIG. 6), while the other, front, longitudinal end 74 is shaped as a bent connecting tab. Each blade 70 is thus shaped as an elastic beam that bends vertically, the front longitudinal end of which is trapped in the insulating support. When each contact blade 70 is in the state of rest illustrated for example in FIGS. 5 and 6, all the tops of the free contact ends 72 are substantially coplanar and project vertically upwards above the bottom plane 46.

In this type of connector for connecting an SD type card, the tops of the convex contact ends 72 of all the contact blades are not transversely aligned. The relative longitudinal position of the ends 72 depends on the type of card and on the application for which the connector and the card are used. However, there is always a series or group of contact blades 70 with ends or tops 72 that are aligned, the offset of the other tops generally being very small. There is a center of force along vertical axis Cf (FIG. 1) along which an upward force is applied to a card.

Figure 13:
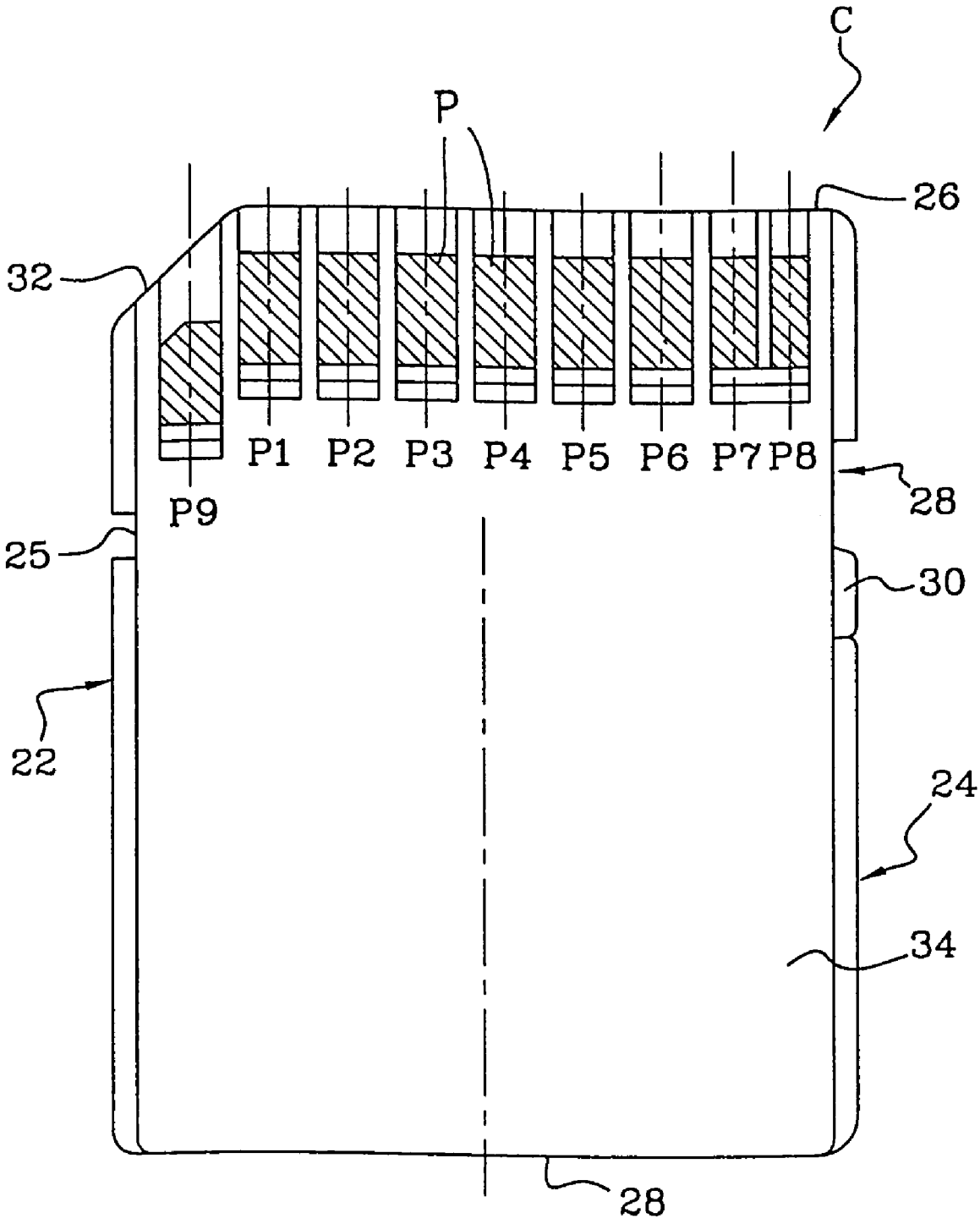
FIG. 13 is a schematic view from beneath of a card of the SD type intended to be received in a connector illustrated in the preceding figures.

In the first embodiment, there are five blades with ends 72 which are transversely aligned and which correspond to the pads P1–P2 and P5–P8 of the card C (FIG. 13). The blade ends corresponding to P3 and P4 are almost aligned with those P1–P2 and P5–P8 (they are spaced from plane Pv by no more than the thickness of the card) that they can be said to be substantially aligned along vertical plane Pv (FIG. 8).

According to one aspect of the invention, near the cavity front transverse edge 56 (FIG. 6), the card-receiving cavity 44 has a recess 76 with a bottom forming an inclined plane 78. The plane 78 extends to the transverse edge 56.

The cover element 80 in this instance is a metal part made of pressed and bent cut sheet metal. The cover element has a rectangular upper horizontal plate 82 with a front transverse edge 84 and a rear portion 85 with a transverse edge 86. The rear portion is bent slightly vertically upwards to form an inclined chamfer 88 (FIG. 6) for guiding the card as it is introduced. The lower rear face at A has a radius of curvature that is at least half the thickness T of the sheet metal and preferably at least equal to the thickness. The actual center of curvature is at B.

The intersection between the chamfer 88 (FIG. 6) and the lower face 90 of the cover element forward of the bend at A forms the transverse rear edge lower face A for guiding the card, as will be explained later on. For guidance in sliding on the insulating support 40, the cover element 80 (FIG. 1) comprises two bent-down sides including right 92 and left 94 sides. Each side has two 90° bends at its bottom to hug the opposite sides 95 of the insulating support 40.

Figure 4:
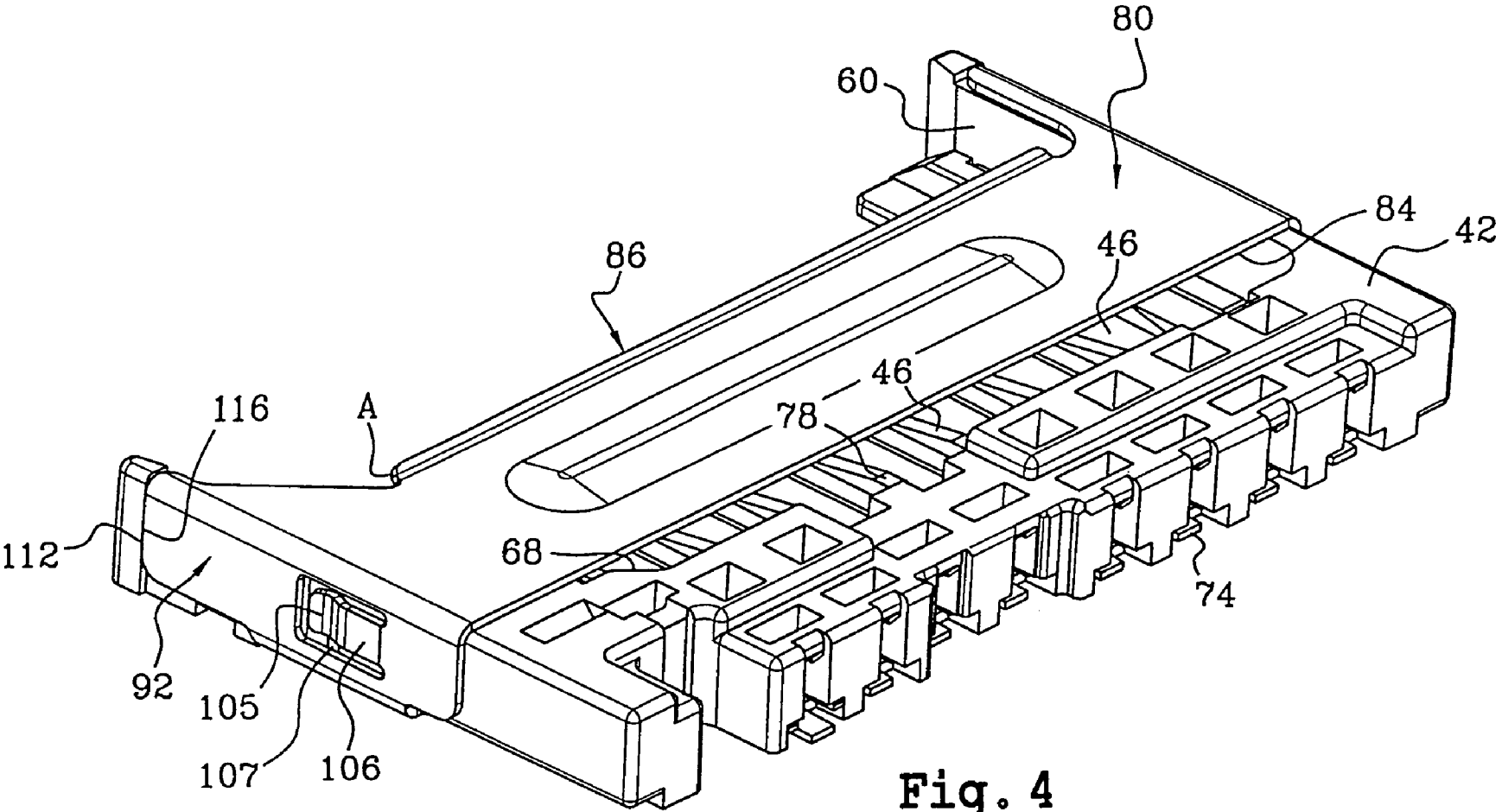
FIG. 4 is a top and rear isometric view of the connector of FIG. 3.
Figure 6:
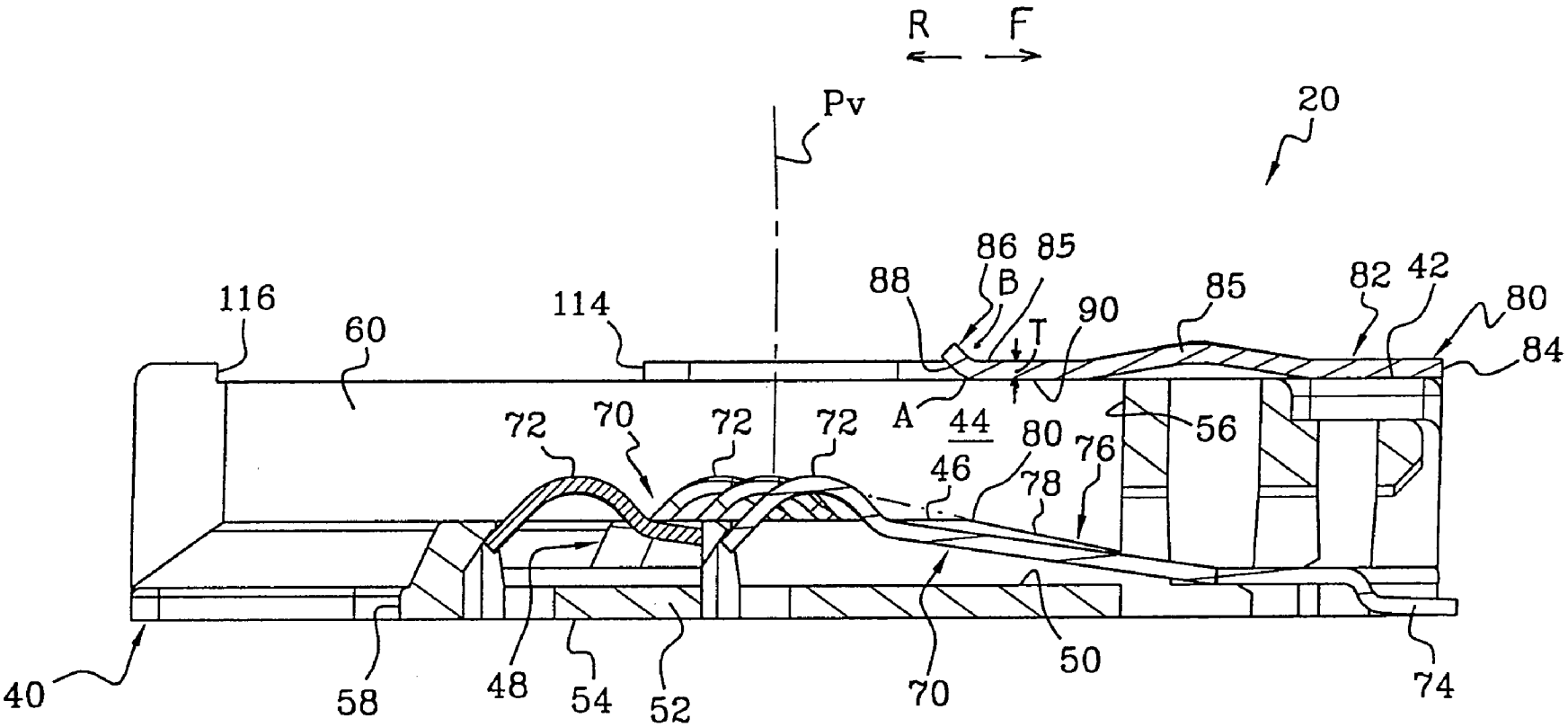
FIG. 6 is a sectional view of the connector of FIG. 1.

The cover element 80 is mounted to slide longitudinally between its forward position depicted in FIGS. 1 and 6 and its rear locking position depicted in FIGS. 4 and 8. The forward position of the cover element 80 is determined by the abutment of the front free ends of two stop tabs 96, 98 (FIG. 2) formed in the lower horizontal flanges 100 and 102 of the cover. The stops 96, 98 abut walls at rear ends of grooves formed in the lower face 54 of the insulating support 40. Forming the sides 95 of the insulative support with grooves 107, 109 (FIG. 1) into which the cover side rear edges 112, 114 snap during forward movement of the cover, gives the user a tactile and audible feel of the locking of the cover element 80 in its extreme forward longitudinal position. The extreme rear locked position is limited by the rear transverse edges 112 and 114 of the slideways 92 and 94 of the cover coming into abutment against the facing edges 116 and 118 of the insulating support.

FIGS. 1 and 2 show that the vertical side walls of the cover slideways each comprises a tab 104, 105 extending inward and having a rear free end 103, 105 which bears elastically against a lateral side 95 of the insulating support 40. Each side 95 has a V-shaped notch 107, 109, so as to partially immobilize the cover 80 in its extreme rear longitudinal position to prevent any unwanted movement of the cover when it is not being deliberately manipulated and to afford the tactile and audible sensations of locking. Sliding the cover in front and rear directions is made easier by the raised rib 85 (FIG. 1) formed in the upper plate 82.

The way in which the connector 20 works and is used will now be described with reference to FIGS. 6 to 9D. When the cover 80 is in the forward position, as can be seen in FIG. 6, the cavity 44 is largely uncovered so it can be accessed vertically from above. That is, only a rear part of the upper plate 82 extends rearward beyond the cavity front edge 56. In this position, the lower rear face A in combination with the inclined recess plane 78 and the tops of the convex contact ends 72 of the contact blades constitute guide means. This allows the card C to be introduced in the inclined direction illustrated in FIGS. 7 and 9B. This introduction along a plane inclined by an angle $\alpha$ with respect to the horizontal is performed until the front edge 26 of the card C abuts the front edge 56 of the housing 44.

Figure 9B:
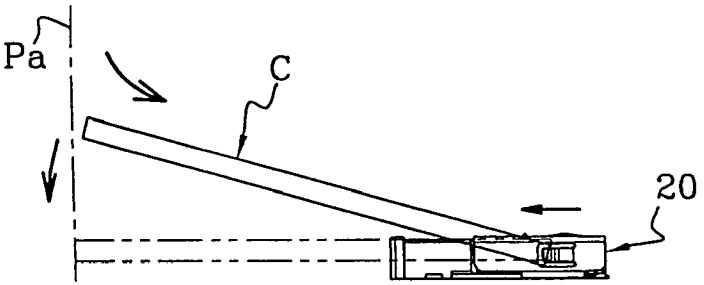
FIGS. 9A to 9D are schematic side views of the connector illustrating the various successive positions of the card and of the moving cover element.
Figure 9D:
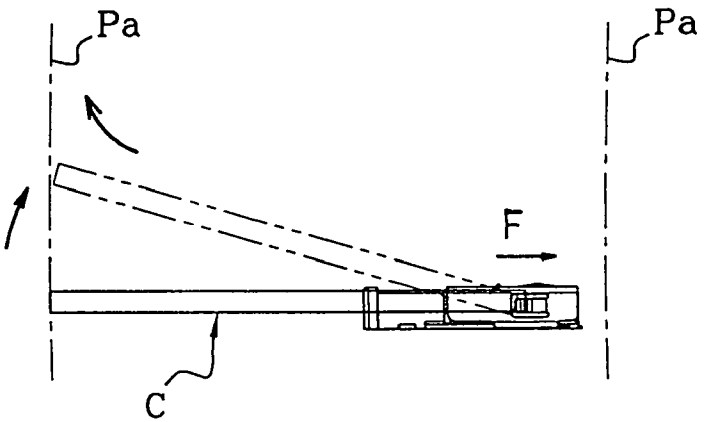
Figure 9A:
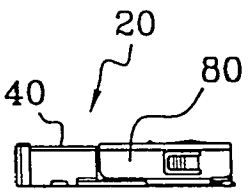

As was explained in the introduction, and as illustrated schematically in FIGS. 9A to 9D, a vertical wall Pa, or similar elements, may lie behind the card C and prevent horizontal rearward movement of the card more than a small amount (e.g. a few millimeters) from its fully installed position (FIG. 9D).

Figure 7:
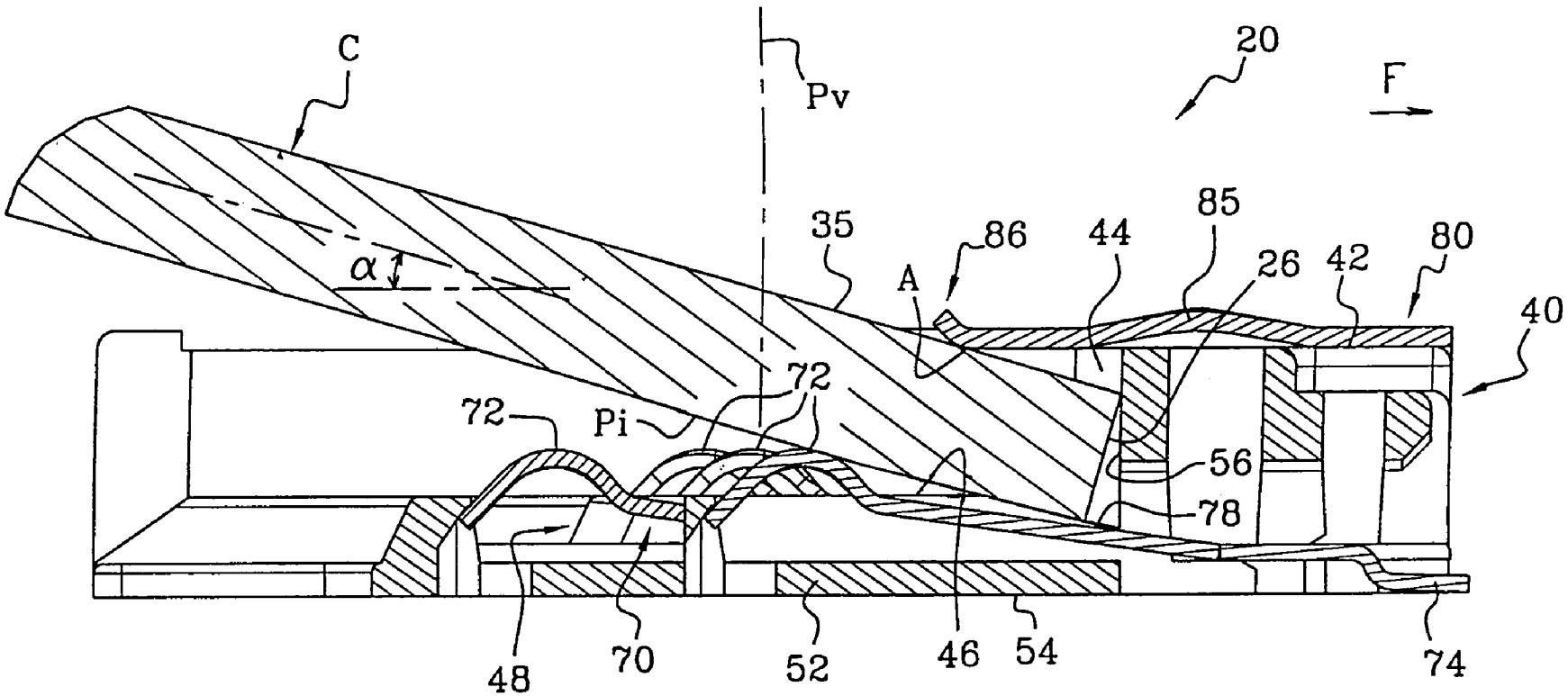
FIG. 7 is a view similar to that of FIG. 6, in which a card is depicted while it is being introduced in an inclined intermediate position.
Figure 9C:
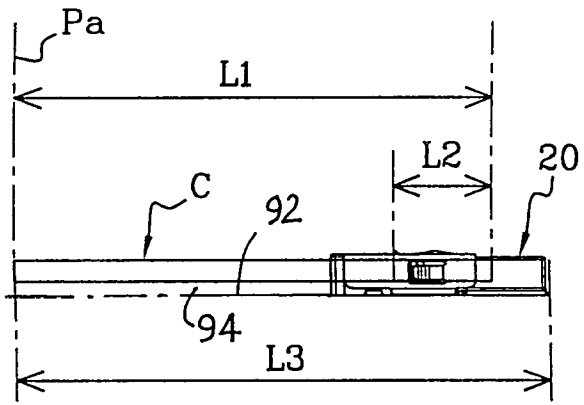

In the course of card insertion movement, the portion of the upper face 35 (FIG. 7) of the card C facing the lower rear face A, slides along the face A and also pivots about the latter according to the angle at which the user initially introduced the card C into the housing 44, until the card reaches the position depicted in FIG. 7. In this position, if the user lets go of the card, the card remains stable in an inclined position, this position constituting an inclined intermediate position of insertion before the card is placed in a horizontal position as illustrated in FIGS. 8 and 9C. After the card reaches the position in FIG. 7, the user preferably presses on the upper face of the card with a finger to bring it substantially into a horizontal position by pivoting of the card in the anticlockwise direction when considering the figures. Next, he or she moves the cover 80 forward F, using another finger.

During pivoting of the card between the tilted position of FIG. 7 and the horizontal position of FIG. 8, the card engages sheet metal parts of large radius of curvature. The card top engages the convex lower rear face A of the cover. The card bottom engages the contact ends 72 of the blades. This avoids scratching the card faces.

During the initial tilting movement to reach the position depicted in FIG. 8, collaboration between the lower face 34 of the card and its conducting pads causes the contact blades to bend. To prevent the card C from retreating because of the friction at the edge face A during the locking movement of the cover element 80, the user may keep the card pressed forwardly against the cavity front edge 56. The locking movement causing the card C to be brought into a contact position then may be easy to perform with just one hand using the thumb collaborating with the rear transverse edge 28 of the card while the index finger collaborates with the rib 85 of the cover element 80 to perform the locking.

If there is a vertical wall Pa (FIG. 9B) close to the rear transverse edge of the card, then this wall constitutes an end stop that prevents any retreat of the card longitudinally backwards during the locking movement of the cover 80.

Figure 5:
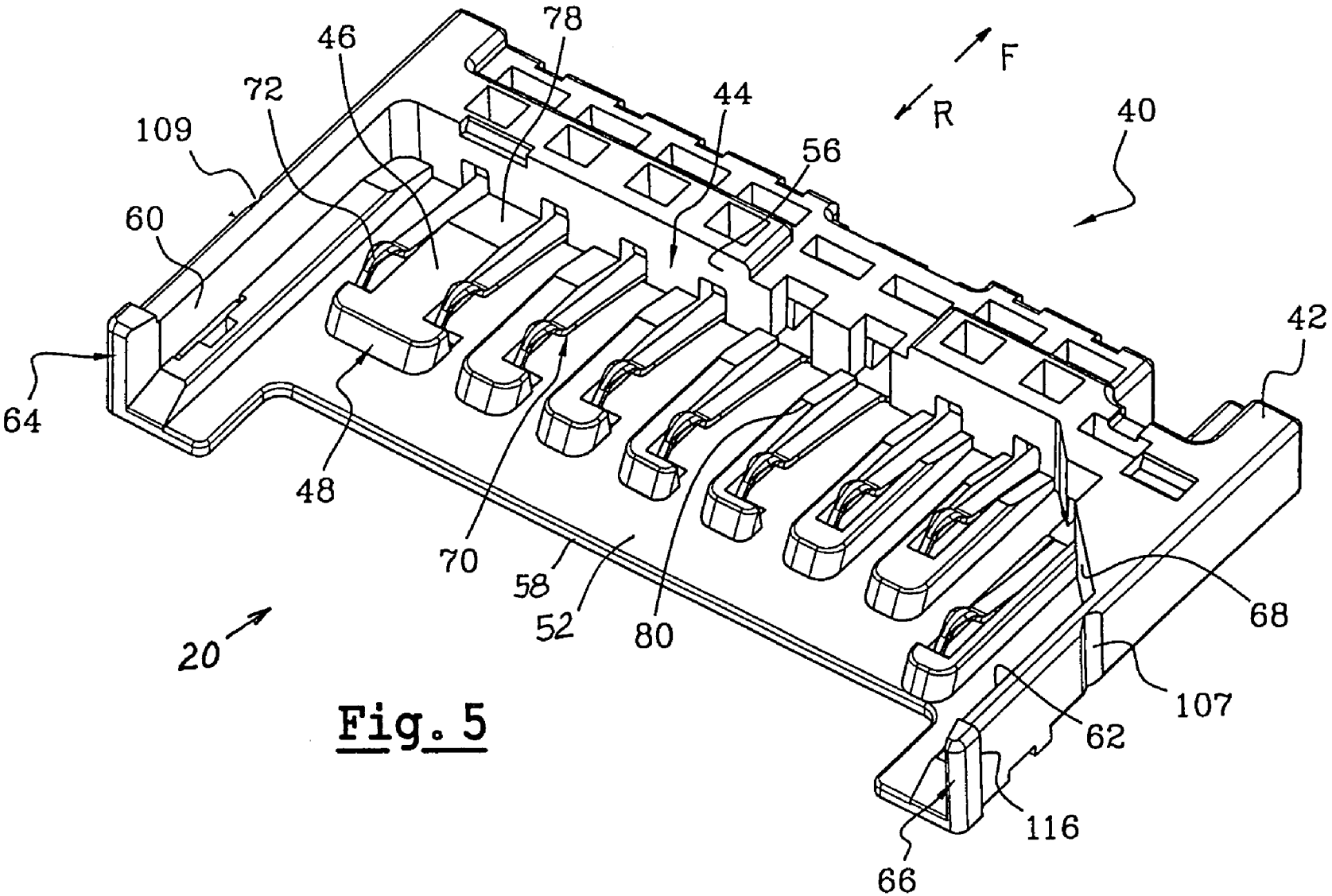
FIG. 5 is a view similar to that of FIG. 1, in which the connector is shown without the cover element.

As can be seen in FIG. 9C, in the fully inserted card position, the length L2 of the front section of the card C housed in the cavity 44 is no more than one-half, preferably no more than one third, or 33% and most preferably no more than 25% of the total length L1 of this card and is also less than the width of the card. This proportion does not take account of continuations of the connector that may vary from one model to another. That is the length of the card-receiving cavity is the distance separating edges 56 and 58 (FIG. 5).

In the horizontal contact position depicted in FIG. 8, the elastic blades ends 72 constantly urge the card C elastically, or resiliently upwards. As a result, a portion of the upper face 35 of the card presses against a cover lower face portion 90.

When the user wishes to extract the card C, and as illustrated schematically in FIG. 9D, all he has to do (starting out from the position depicted in FIGS. 8 and 9C) is to unlock the cover 80 by sliding it forward F to its forward position. During this retreating movement of the cover, the blade contact ends 72 elastically urge the card C upwards overall, tending to return to their rest position depicted in FIG. 6. As soon as the lower rear face A of the upper plate 82 passes the vertical plane Pv (FIG. 7) of the blade contact ends 72, the card C is automatically tilted into its inclined position depicted in FIGS. 7 and 9D which is once again a stable intermediate position for the card.

In this position, it is possible for the user to take hold of the card particularly via its rear longitudinal end section. Thus, even when the periphery of the connector on the printed circuit board is laterally and/or longitudinally surrounded, the card in the inclined positions (FIGS. 7 and 9B) is accessible to the user. The design of the connector and of the cover 80 is therefore such that, when the cover is in the rear position, the edge face A is rearward of plane Pv, and when the cover 80 is in the forward position, the edge face A is forward of the plane Pv.

The effect of partial automatic ejection of the card is thus obtained in a reliable way through the upward force of the elastic contact blades 70 without there being any need, as there was in the prior art, to resort to an additional ejection blade such as one molded with the insulating support.

The automatic ejection effect obtained by the contact blades 70 in the lower part of the insulating support 40, is obtained without significantly increasing the total height of the connector. A minimum total thickness of the connector is an important advantage particularly sought after in numerous applications such as in radio telephones, or personal digital assistants (PDAs). Furthermore, more than half of the card C projects unsupported over the printed circuit board 92 (FIG. 9C) that bears the connector. This leaves a space 94 between the lower face of the card and the printed circuit card. This space 94 above the upper face of the printed circuit board can be used, in particular, for electronic circuit board components.

In the case of an SD card the total length of which is 32 mm, in the particular illustrated connector only 7.9 mm of the card is housed in the cavity, between the cavity edges 56 and 58, while 26 mm projects unsupported. The total length L3 (FIG. 9C) of the card and of the connector 20 is equal to about 35.3 mm.

Figure 10:
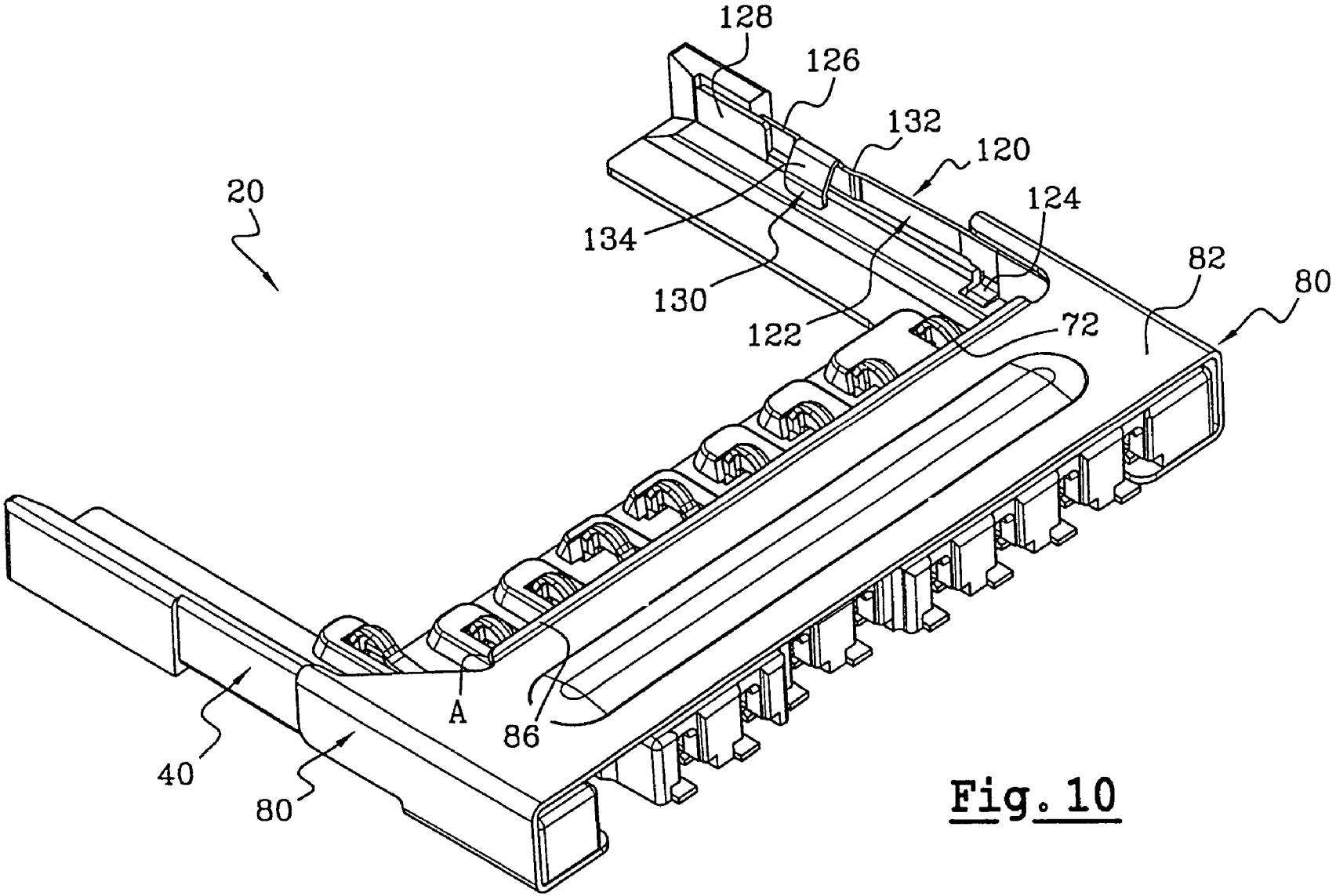
FIG. 10 is a top rear isometric view of a second embodiment of a connector according to the invention which includes a switch for detecting the state of a write-protect device protecting the card that it can receive.
Figure 11:
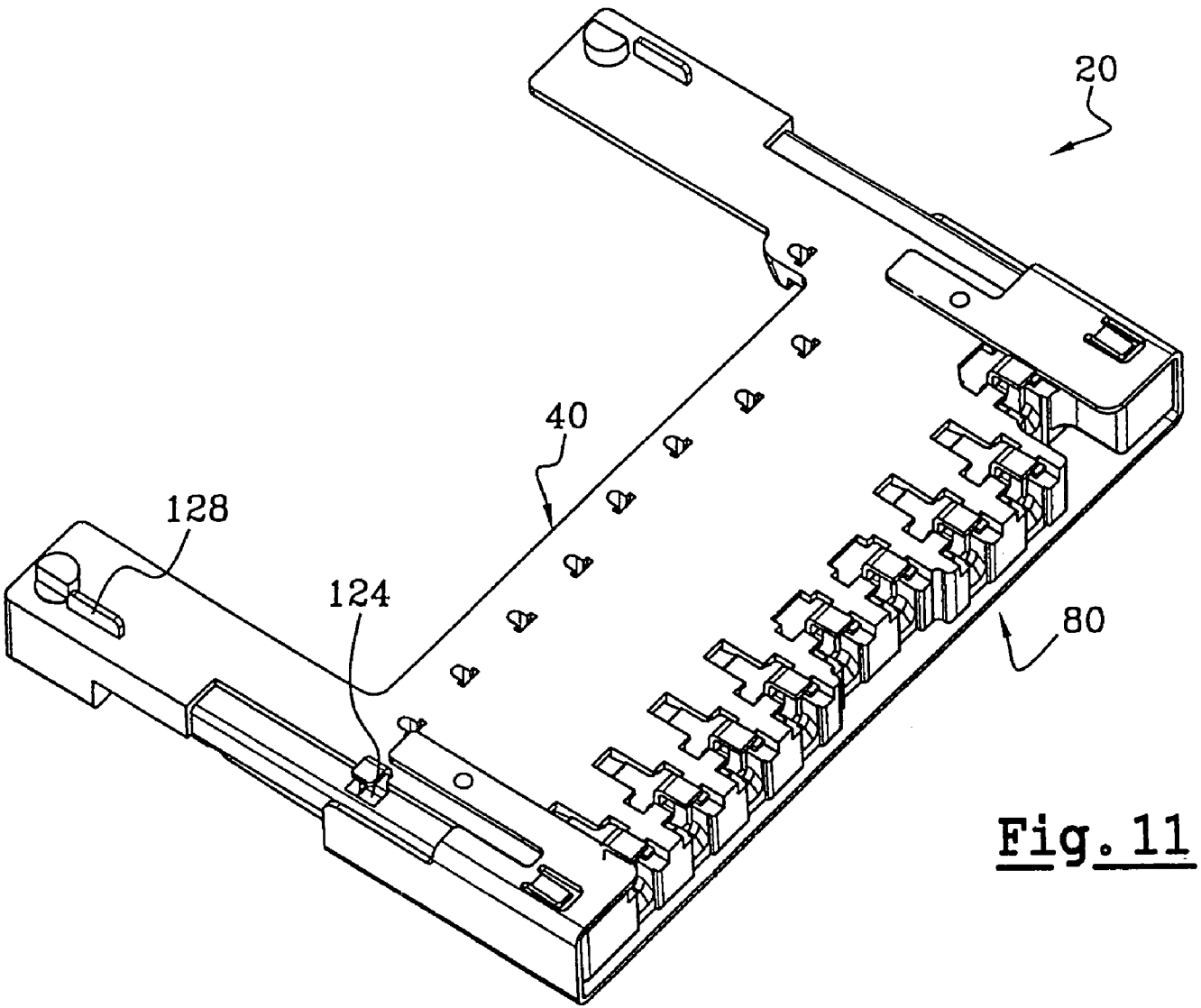
FIG. 11 is an upside-down isometric view of the connector of FIG. 10.
Figure 12:
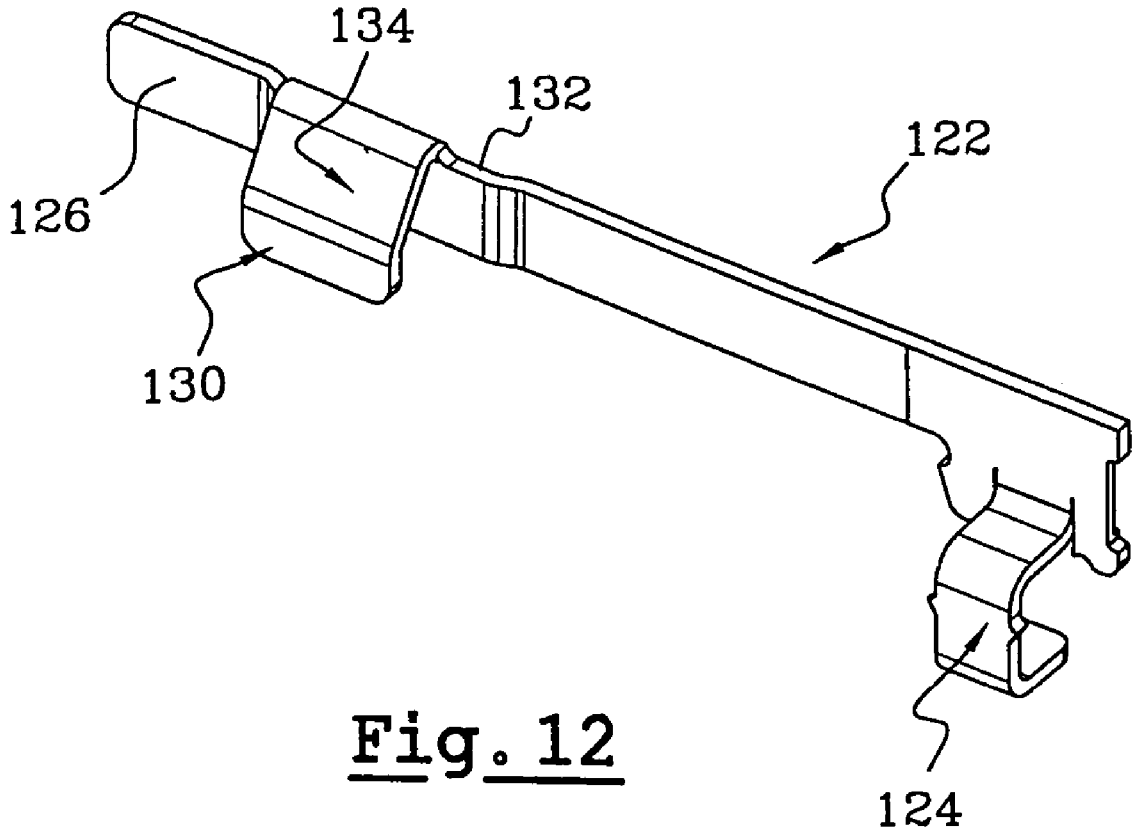
FIG. 12 is an enlarged isometric view of the moving blade of the switch of the connector depicted in FIGS. 10 and 11.

A second embodiment of the invention shown in FIGS. 10–12 differs from the previous one by the presence of a switch 120. The switch detects the write protect device 28, 30 (FIG. 13) on the card C and will now be described.

In a way which is generally known, the switch 120 (FIG. 10) comprises a moving detection blade 122 mounted on the insulating support in which the blade front leg 124 is embedded.

The rear free end 126 of the detection blade 122 normally (in its illustrated state of rest) engages a fixed contact 128. The fixed contact 128 is also mounted on the insulating support, so the switch is of the normally closed NC type.

By way of an alternative that has not been depicted, the switch 120 could also be of the normally open NO type, as is known in the prior art. In that case the free end 126 then contacts a metal part such as part of the moving cover 80.

Near its rear longitudinal end 126, the blade 122 has a deflection portion 130 extending generally transversely towards the inside of the card-receiving cavity 44, so as to be able to collaborate, or not, with the slider 30 (FIG. 13) of the card, depending on the longitudinal position of this slider.

FIG. 12 shows that the blade deflection portion 130 extends from the upper longitudinal edge 132 of the blade 122 and is then bent inwards and downwards to define a portion 134 that forms a control and ejection ramp inclined downwards and inwards.

When a card is inserted, and more particularly when the card is tilted from its position illustrated in FIG. 7 to the position illustrated in FIG. 8, the lower edge of the card slider 30, if this slider is in the corresponding longitudinal position, collaborates with the ramp 134 to facilitate the moving-aside of the portion 130 and cause the opening of the switch 120. Conversely, when the user unlocks the cover element 80 by moving it forward, the ramp 134 contributes to the movement of ejecting the card by applying an additional elastic force to this card because of the collaboration between the inclined ramp 134 and the lower edge of the card slider 30.

Although terms such as "top", "bottom", etc. have been used to help describe the connector as it is illustrated, the connector can be used in any orientation.

What is claimed is:

1. An electrical connector for a smart card of rectangular overall shape having a lower face with conducting pads, the pads of a fully inserted card engaging contact ends of elastically deformable conducting blades lying at the bottom of a card-receiving cavity that is formed in part by an insulative support that has a cavity bottom surface (46) that forms the bottom of the cavity, the connector including a sheet metal cover that is mounted on the support, wherein:

said cover is slideably mounted on the support to slide between a rearward cover position and a forward cover position;

said insulative support forms an inclined surface (78) that extends at a forward-downward incline below said cavity bottom surface and that guides the front of the card when said card extends at a forward-downward incline during an initial card insertion;

said cover has a rear end that is bent upward to form a chamfer (88), and in said cover forward position said chamfer and said inclined surface are positioned so the cover chamfer (88) guides the upper surface of the inclined card while the insulative support inclined surface (78) guides the lower front of the card, said cover being slideable rearwardly over a card that has been pivoted down to the horizontal after the initial card insertion to press down the card against said contact ends of said blades wherein the rear end of the cover has a surface location that is aligned with a forward end of the inclined surface.

2. The connector described in claim 1 wherein:

said contact ends of said blades are biased to positions above said cavity bottom surface (46), but are deflectable below said cavity bottom surface;

the vertical distance between said cavity bottom surface and a lower surface of said cover that lies above said cavity bottom surface, at a location rearward of said inclined surface that lies below said cavity bottom, is about equal to the thickness of said smart card, and the cover has a lower surface that presses down the card after the card has been pivoted to the horizontal.

* * * * *